US009858912B2

(12) United States Patent
Hamalainen

(10) Patent No.: US 9,858,912 B2
(45) **Date of Patent: *Jan. 2, 2018**

(54) APPARATUS, METHOD, AND COMPUTER PROGRAM FOR ADJUSTABLE NOISE CANCELLATION

(71) Applicant: Nokia Technologies Oy, Espoo (FI)

(72) Inventor: Matti S Hamalainen, Lempaala (FI)

(73) Assignee: Nokia Technologies Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/007,416

(22) Filed: Jan. 27, 2016

(65) Prior Publication Data

US 2016/0140947 A1 May 19, 2016

Related U.S. Application Data

(63) Continuation of application No. 13/699,783, filed as application No. PCT/IB2010/001496 on Jun. 21, 2010, now Pat. No. 9,275,621.

(51) Int. Cl.
*H04R 25/00* (2006.01)
*G10K 11/00* (2006.01)
(Continued)

(52) U.S. Cl.
CPC ..... *G10K 11/002* (2013.01); *G10K 11/178* (2013.01); *H04R 1/1083* (2013.01);
(Continued)

(58) Field of Classification Search
CPC ..... G10L 19/008; H04R 5/033; H04R 1/1083; H04S 2400/03
(Continued)

(56) References Cited

U.S. PATENT DOCUMENTS 2,830,481 A * 4/1958 Hanert ..... G10H 1/0091 84/671
4,856,401 A * 8/1989 McClish ..... G10H 1/06 84/735
(Continued)

FOREIGN PATENT DOCUMENTS

EP 1770685 A1 4/2007
GB 2431313 A 4/2007
(Continued)

OTHER PUBLICATIONS

Texas Instruments; "Design of Active Noise Control Systems With the TMS320 Family, Application Report, Digital Signal Processing Solutions"; 1996; whole document (171 pages).
(Continued)

*Primary Examiner* — Alexander Jamal
(74) *Attorney, Agent, or Firm* — Harrington & Smith

(57) ABSTRACT

From inputs received at one or more processors, a background audio signal representing background sound is separated from a primary audio signal. The primary audio signal is output with the background audio signal or an altered version thereof according to a user selection between noise cancellation and ambient sound reproduction. More specifically, when the user selection is for noise cancelation, the primary and background audio signals are output with a first altered version of the background audio signal (for example, having inverted phase so as to destructively interfere with the background audio signal); and when the user selection is for ambient sound reproduction, the primary audio signal is output with the background audio signal or a second altered version of the background audio signal (such as a pseudo-acoustic representation of the background sound). One example embodiment is a headset with microphones and speakers for the respective inputs and outputs.

17 Claims, 6 Drawing Sheets

(51) Int. Cl.
*G10K 11/178* (2006.01)
*H04R 1/10* (2006.01)
*H04R 5/033* (2006.01)

(52) U.S. Cl.
CPC ..... *H04R 5/033* (2013.01); *G10K 2210/1081* (2013.01); *G10K 2210/111* (2013.01); *H04S 2400/15* (2013.01)

(58) Field of Classification Search
USPC ..... 381/17, 22, 23, 310, 71.1, 71.2, 71.8, 381/94.2–94.9, 74, 103, 317
See application file for complete search history.

(56) References Cited

U.S. PATENT DOCUMENTS

| | | | |
|---|---|---|---|
| 6,278,786 | B1 | 8/2001 | McIntosh |
| 6,402,782 | B1 | 6/2002 | Sibbald et al. |
| 7,065,219 | B1 | 6/2006 | Abe et al. |
| 7,903,826 | B2 | 3/2011 | Boersma |
| 2001/0046304 | A1 | 11/2001 | Rast |
| 2003/0035551 | A1 | 2/2003 | Light et al. |
| 2005/0238180 | A1 | 10/2005 | Chen |
| 2006/0153394 | A1 | 7/2006 | Beasley |
| 2006/0262938 | A1 | 11/2006 | Gauger, Jr. et al. |
| 2008/0076489 | A1 | 3/2008 | Rosener et al. |
| 2009/0046868 | A1* | 2/2009 | Engle ..... G10K 11/1788 381/74 |
| 2009/0262969 | A1 | 10/2009 | Short et al. |
| 2010/0105447 | A1 | 4/2010 | Sibbald et al. |
| 2010/0250253 | A1* | 9/2010 | Shen ..... H04R 1/1041 704/260 |
| 2011/0103610 | A1 | 5/2011 | Harsch |
| 2011/0313653 | A1 | 12/2011 | Lindner ..... 701/201 |
| 2012/0101819 | A1 | 4/2012 | Heiman et al. |

FOREIGN PATENT DOCUMENTS

| | | | |
|---|---|---|---|
| JP | 2001124582 | A | 5/2001 |
| JP | 2002286494 | A | 10/2002 |
| JP | 2004150918 | A | 5/2004 |
| JP | 2004219293 | A | 8/2004 |
| JP | 2006227111 | A | 8/2006 |
| WO | WO-2005/004534 | A1 | 1/2005 |
| WO | WO-2007/011337 | A1 | 1/2007 |
| WO | WO-2008/119122 | A1 | 10/2008 |
| WO | 2009042651 | A2 | 4/2009 |

OTHER PUBLICATIONS

Polycom; "Polycom SoundStructure: Architect's and Engineer's Specifications"; 2007; whole document (4 pages).

* cited by examiner

APPARATUS, METHOD, AND COMPUTER PROGRAM FOR ADJUSTABLE NOISE CANCELLATION

CROSS REFERENCE TO RELATED APPLICATION

This application is a continuation of U.S. patent application Ser. No. 13/699,783, filed on Jan. 15, 2013; which was itself a US national stage application from PCT/IB2010/001496 filed on Jun. 21, 2010.

TECHNICAL FIELD

The present disclosure relates to the field of audio communication, audio headsets and audio signal processing algorithms, associated apparatus, methods and computer programs. In particular, it concerns apparatus such as an audio headset with user-controlled augmented reality audio (ARA) and active noise cancellation (ANC) functionalities. Certain disclosed aspects/embodiments relate to portable electronic devices, in particular, so-called hand-portable electronic devices which may be hand-held in use (although they may be placed in a cradle in use). Such hand-portable electronic devices include so-called Personal Digital Assistants (PDAs).

The portable electronic devices/apparatus according to one or more disclosed aspects/embodiments may provide one or more audio/text/video communication functions (e.g. tele-communication, video-communication, and/or text transmission, Short Message Service (SMS)/Multimedia Message Service (MMS)/emailing functions, interactive/non-interactive viewing functions (e.g. web-browsing, navigation, TV/program viewing functions), music recording/playing functions (e.g. MP3 or other format and/or (FM/AM) radio broadcast recording/playing), downloading/sending of data functions, image capture function (e.g. using a (e.g. in-built) digital camera), and gaming functions.

BACKGROUND

Headphones are used with both fixed equipment (e.g. home theatre and desktop computers) and portable devices (e.g. mp3 players and mobile phones) to reproduce sound from an electrical audio signal. To maximize the clarity of audio playback, headphones are typically designed to prevent as much background (ambient) noise as possible from reaching the user's eardrums. This can be achieved using both passive and active noise control. Passive noise control involves attenuation of the acoustic signal path to the ear canal, whilst active noise control involves the generation of a noise cancellation signal to interfere destructively with the background noise.

There are some scenarios, however, where the detection of background noise is desirable. For example, some people enjoy listening to music on their mp3 players whilst walking around outside. In busy urban surroundings, such as city centers, there is often a lot of traffic on the roads. In this situation, headphones can inhibit a user's ability to detect approaching traffic, and therefore present a potential health risk.

Another example is for call center staff who require audio headsets for simultaneous conversation and typing, and who need to be able to hear instructions from their superiors in the office whilst involved in a telephone conversation with a customer.

One way of overcoming this problem is to use a single earpiece (monaural) for audio reproduction, rather than an earpiece for each ear (binaural). However, because each ear detects a different sound, monaural headphones can be disorientating for the user. In addition, two earpieces are required in order to play two audio channels simultaneously, so stereo sound cannot be reproduced with monaural headphones.

Another option is to use an augmented reality audio (ARA) headset, which allows the playback of both primary and background audio signals at the same time. Nevertheless, there are scenarios where a user may still wish to block out some or all of the background sounds. For example, if a user is travelling by bus, he/she may not wish to hear the conversations of other passengers or the rumble of the wheels on the road surface whilst listening to music on an mp3 player, and so would appreciate the option of being able to cancel the background sounds. On the other hand, the same user may wish to hear some of the background sound, such as travel announcements, from the bus conductor or driver.

In these situations, the use of active noise control (ANC) with an ARA headset may be advantageous. However, currently available ANC headsets tend to cancel out all environmental sounds and are therefore unsuitable for this purpose.

The apparatus and associated methods disclosed herein may or may not address these issues.

The listing or discussion of a prior-published document or any background in this specification should not necessarily be taken as an acknowledgement that the document or background is part of the state of the art or is common general knowledge. One or more aspects/embodiments of the present disclosure may or may not address one or more of the background issues.

SUMMARY

According to a first aspect, there is provided an apparatus comprising: at least one processor; and at least one memory including computer program code, the at least one memory and the computer program code are configured, with the at least one processor, to cause the apparatus to perform at least the following: from inputs received at the at least one processor, separate a background audio signal representing background sound from a primary audio signal; and output the primary audio signal with the background audio signal or an altered version thereof according to a user selection between noise cancellation and ambient sound reproduction. More specifically, when the user selection is for noise cancelation the primary audio signal and the background audio signal are output with a first altered version of the background audio signal. In one embodiment this first altered version of the background signal has inverted phase so as to destructively interfere with the background audio signal. And when the user selection is for ambient sound reproduction, the primary audio signal is output with the background audio signal or a second altered version of the background audio signal. In one embodiment this second altered version of the background audio signal is a pseudo-acoustic representation of the background sound.

Accordingly, there is provided an apparatus (one example below is an audio headset) with user-controlled active noise cancellation (ANC) functionalities.

The apparatus may comprise digital and/or analogue electronics (circuitry and components), and may be configured to process digital and/or analogue signals. The processor may be a processing unit comprising one or more of the following: a digital processor, an analogue processor, a programmable gate array, digital circuitry, and analogue circuitry. The memory may be a memory unit comprising one or more of the following: a storage medium, computer program code, and logic circuitry. The computer program may comprise one or more of the following types of parameter: variables of the computer program code, programmable logic, and adjustable components of the digital and/or analogue circuitry.

The user-controllable characteristics of the noise cancellation signal may include one or more of the frequency of the noise cancellation signal, the amplitude of the noise cancellation signal, and the phase relationship between the noise cancellation signal and the background audio signal. In this manner when the background (noise) audio signal is altered to be such a noise cancellation signal, at least one characteristic of the background noise signal is altered in such a way as to enable reproduction of the primary audio signal substantially without the background noise signal.

In one embodiment, the frequency and amplitude of the noise cancellation signal may be identical to the respective frequency and amplitude of the background audio signal. In this embodiment, the apparatus may be configured to allow the user to vary the phase relationship between the noise cancellation signal and the background audio signal to alter the amplitude of the background audio signal provided to the user of the apparatus/headset.

In another embodiment, the frequency of the noise cancellation signal may be identical to the frequency of the background audio signal and the noise cancellation audio signal may be 180 degrees out of phase with background audio signal. In this embodiment, the apparatus may be configured to allow the user to vary the amplitude of the noise cancellation signal to alter the amplitude of the background audio signal.

The apparatus, processor and/or memory may be configured to equalize the background audio signal to remove audio artefacts introduced by the earpiece to produce an equalized background audio signal. In this scenario, the noise cancellation signal may be configured to interfere destructively with the equalized background audio signal to alter the amplitude of the equalized background audio signal.

The apparatus, processor and/or memory may be configured to do one or more of the following in order to equalize the background audio signal: recreate the quarter-wave resonance associated with an open ear canal, dampen the half-wave resonance associated with a closed ear canal, and compensate for the boosted low frequency reproduction associated with sound leakage between the earpiece and the user.

The apparatus, processor and/or memory may be configured to receive a primary audio signal from a primary audio source. The apparatus may be configured to combine the primary audio signal with the altered background audio signal/noise cancellation signal to produce a combined audio signal.

Accordingly, there is provided an apparatus (e.g. an audio headset) with user-controlled augmented reality audio (ARA) and active noise cancellation (ANC) functionalities.

The apparatus, processor and/or memory may be configured to send the combined audio signal to an earpiece loudspeaker for audio reproduction. The apparatus, processor and/or memory may be configured to receive the background audio signal from two binaural earpiece microphones and send the combined audio signal to two respective earpiece loudspeakers for binaural audio reproduction. The apparatus, processor and/or memory may be configured to send the combined audio signal to a transmitter. The transmitter may be configured to transmit the combined audio signal to a device at a location remote to the apparatus.

The primary audio signal may be received from a device at a location remote to the apparatus. The primary audio signal may be received from a microphone comprising part of the apparatus. The primary audio signal may be a stored audio file. One or more of the primary audio signal, background audio signal, noise cancellation signal, and combined audio signal may be analogue electronic signals.

The apparatus may comprise at least one earpiece comprising the earpiece microphone for receiving the background audio signal and the earpiece loudspeaker for playing the combined audio signal to a user. The earpiece may be configured to provide passive attenuation of sound from the surrounding environment. The apparatus may comprise a user interface. The user interface may be configured to allow a user of the apparatus to control the generation and characteristics of the noise cancellation signal. The user interface may be configured to allow a user of the apparatus to choose between complete, partial, or no cancellation of the background audio signal. The apparatus may be configured to control the generation and characteristics of the noise cancellation signal automatically based on context information. The context information may comprise information on the user's actions, location, active applications (e.g. mp3 player, telephone call etc), or characteristics of the acoustic environment. The apparatus may be configured to monitor and store user interface settings. The apparatus may be further configured to control the generation and characteristics of the noise cancellation signal automatically using the stored user interface settings.

According to a further aspect, there is provided a portable electronic device comprising any apparatus described herein.

According to a further aspect, there is provided a module for a portable electronic device, the module comprising any apparatus described herein.

The portable electronic device may be a portable telecommunications device.

The apparatus may be a portable electronic device, circuitry for a portable electronic device or a module for a portable electronic device. The portable electronic device may be a headset for a portable telecommunications device which may or may not have an audio/video player for playing audio/video content or a dedicated audio/video player.

According to a further aspect, there is provided a method of controlling the production of an audio signal, the method comprising: from inputs received at one or more processors, separating a background audio signal representing background sound from a primary audio signal; and outputting the primary audio signal with the background audio signal or an altered version thereof according to a user selection between noise cancellation and ambient sound reproduction. More specifically, when the user selection is for noise cancelation, the primary audio signal and the background audio signal are output with a first altered version of the background audio signal. In one embodiment this first altered version of the background signal has inverted phase so as to destructively interfere with the background audio signal. And when the user selection is for ambient sound reproduction, the primary audio signal is output with the background audio signal or a second altered version of the background audio signal. In one embodiment this second altered version of the background audio signal is a pseudo-acoustic representation of the background sound.

According to a further aspect, there is provided a non-transitory computer readable memory comprising computer readable instructions that when executed, implement a computer program for controlling production of an audio signal. In this aspect the computer program comprises: code for separating a background audio signal representing background sound from a primary audio signal; and code for outputting the primary audio signal with the background audio signal or an altered version thereof according to a user selection between noise cancellation and ambient sound reproduction. More specifically, when the user selection is for noise cancelation, the primary audio signal and the background audio signal are output with a first altered version of the background audio signal. In one embodiment this first altered version of the background signal has inverted phase so as to destructively interfere with the background audio signal. And when the user selection is for ambient sound reproduction, the primary audio signal is output with the background audio signal or a second altered version of the background audio signal. In one embodiment this second altered version of the background audio signal is a pseudo-acoustic representation of the background sound.

The apparatus may comprise a processor configured to process the code of the computer program. The processor may be a microprocessor, including an Application Specific Integrated Circuit (ASIC).

The present disclosure includes one or more corresponding aspects, embodiments or features in isolation or in various combinations whether or not specifically stated (including claimed) in that combination or in isolation. Corresponding means for performing one or more of the discussed functions are also within the present disclosure.

Corresponding computer programs for implementing one or more of the methods disclosed are also within the present disclosure and encompassed by one or more of the described embodiments.

The above summary is intended to be merely exemplary and non-limiting.

BRIEF DESCRIPTION OF THE FIGURES

A description is now given, by way of example only, with reference to the accompanying drawings, in which:

FIG. 2 *b* illustrates schematically interaural level difference;

FIG. 7 *b* illustrates schematically the use of audio cues for sound localization when a user is oriented directly in front of a virtual audio source;

FIG. 7 *c* illustrates schematically the use of audio cues for sound localization when a user is oriented at an angle to a virtual audio source;

DESCRIPTION OF EXAMPLE ASPECTS/EMBODIMENTS

Hearing is the ability to perceive sound, and is one of the traditional five human senses. The sense of sound is important because it increases our awareness of the surrounding environment and facilitates communication with others. In humans, sound waves are perceived by the brain through the firing of nerve cells in the auditory portion of the central nervous system. The ear changes sound pressure waves from the outside world into a signal of nerve impulses sent to the brain. The human ear can generally detect sounds with frequencies in the range of 20-20,000 Hz (the audio range).

Figure 1:
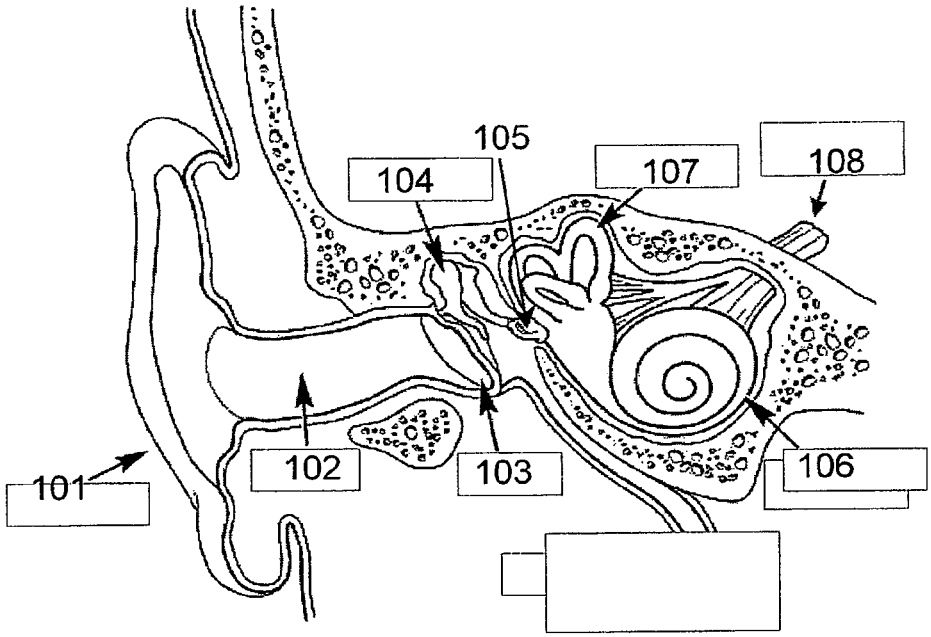
FIG. 1 illustrates schematically the anatomy of the human ear.

The anatomy of the human ear is illustrates in FIG. 1. The outer part of the ear (called the pinna 101) collects sound waves and directs them into the ear canal 102 where the sound waves resonate. The sound waves cause the ear drum 103 to vibrate and transfer the sound information to the tiny bones (ossicles 104) in the middle ear. The ossicles 104 pass the vibration onwards to a membrane called the oval window 105, which separates the middle ear from the inner ear. The inner ear comprises the cochlea 106 (which is dedicated to hearing) and the vestibular system 107 (which is dedicated to balance). The cochlea 106 is filled with a fluid and contains the basilar membrane. The basilar membrane is covered in microscopic hair cells which react to movement of the fluid. When the oval window 105 vibrates, the vibrations cause movement of the fluid, which in turn stimulates the hair cells. The hair cells respond to this stimulation by sending impulses to the auditory nerve 108. The nerve impulses then travel up the brain stem towards the portion of the cerebral cortex dedicated to sound, known as the temporal lobe.

Most vertebrates, including humans, have two ears to facilitate binaural hearing. Binaural hearing allows us to locate sound sources and is achieved using binaural cues. Without binaural cues, it is difficult to determine the location of the source, and the sound is perceived to originate inside the listener's head (known as lateralization).

The sound localization mechanisms of the human auditory system have been extensively studied, and have been found to rely on several cues, including time and level differences between the ears, spectral information, timing analysis, correlation analysis, and pattern matching.

Figure 2A:
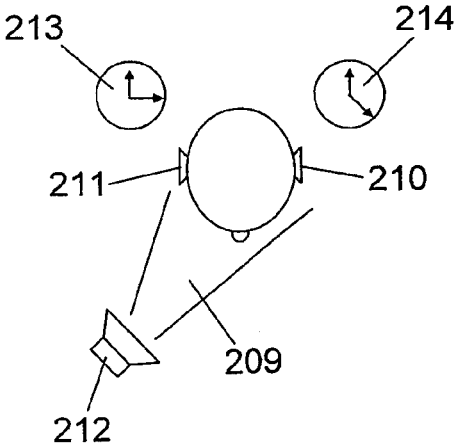
FIG. 2 *a* illustrates schematically interaural time difference.
Figure 2B:
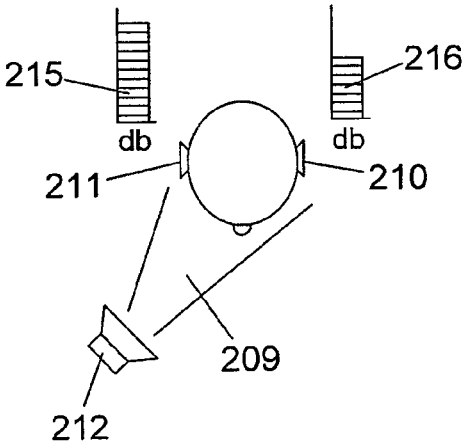

FIG. 2 *a* illustrates the concept of interaural time difference (ITD). ITD is an important binaural cue, and relates to the time difference taken for the same sound wave 209 to reach each of the listener's ears 210, 211. Only when the sound source 212 is equidistant from the ears 210, 211 is there no time difference (e.g. when a person is listening to his/her own voice). If the sound source 212 is located anywhere else, the wavefront 209 travels different distances to the left 210 and right 211 ears, thereby reaching each ear at a slightly different time 213, 214. The maximum possible time difference is just under 700 μs, which corresponds to a sound wave 209 incident directly upon one particular ear 210, 211.

FIG. 2 *b* illustrates the concept of interaural level difference (ILD). ILD is another important binaural cue. ILD relates to the difference in sound pressure level between each of the listener's ears 210, 211. Different sound pressure levels 215, 216 arise because the head 217 shadows the incoming wavefront 209. As a result, a non-shadowed ear 211 experiences a higher sound pressure level 215 than a shadowed ear 216. Due to diffraction effects, the head 217 shadows higher frequencies more than it shadows lower frequencies, so ILD is highly frequency-dependent. Furthermore, the shape of the pinna also has a shadowing effect on the wavefront 209.

For sound source localization, three parameters are required regarding the location of the sound source with respect to each ear. These are azimuth (horizontal angle), elevation (vertical angle), and distance. Azimuth is more accurately detected than elevation because ITD and ILD provide binaural cues in the horizontal plane. In anechoic (echo-free) space, the perception of distance is primarily based on sound intensity, whilst in echoic space, distance is estimated using reverberations of the surrounding environment. The human perception of distance based on these techniques alone is relatively inaccurate, but this can be improved if the sound source is previously known by the listener. This is because the listener has an intuition as to what the noise from the known source should sound like, including the intensity of the sound.

As mentioned above, ITD and ILD provide binaural cues in the horizontal plane. However, the fact that we are able to perceive the height (elevation) of a sound source suggests that a different cue is used for detecting elevation. This cue is known as the Head Related Transfer Function (HRTF). The HRTF influences sound travelling from the sound source to the entrance of the ear canal, and is based on the filtering, colorizing and shadowing effects on the sound wave caused by the asymmetry of the head, pinna, shoulders, and upper torso. Given that everyone has a slightly different shape, the HRTF varies slightly from person to person.

Figure 3:
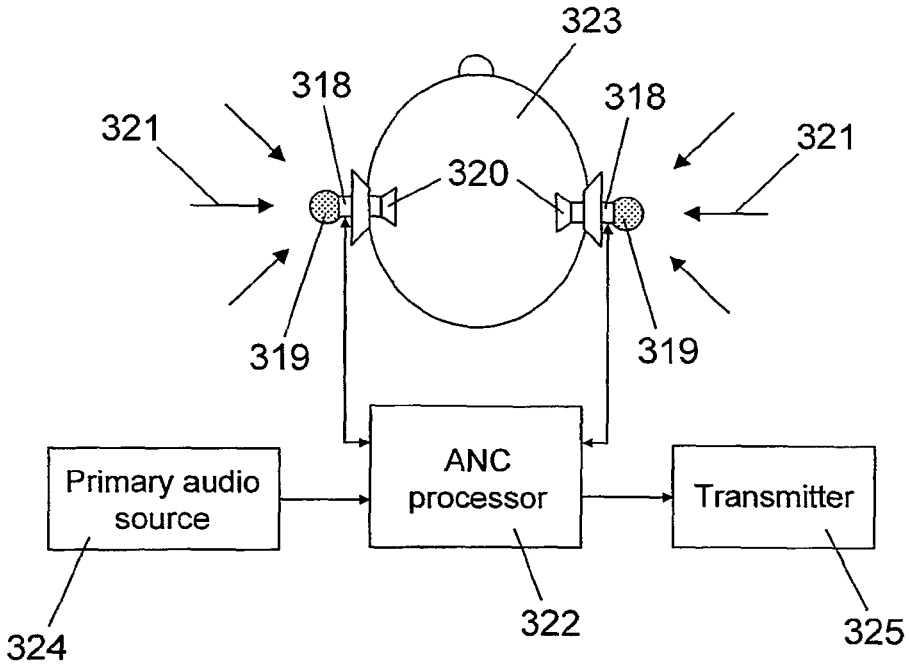
FIG. 3 illustrates schematically an active noise cancellation apparatus.

FIG. 3 illustrates schematically an active noise cancellation (ANC) apparatus. ANC (also known as active noise control, active noise reduction or anti-noise) is a method for reducing unwanted sound. A noise cancellation speaker emits a sound wave with the same amplitude and frequency as the unwanted sound wave, but 180° out-of-phase. When the waves are combined (superpositioned), they cancel one another out as a result of destructive interference.

A typical ANC headset comprises one or more earpieces 318, each comprising one or more microphones 319 and a loudspeaker 320. At least one microphone 319 is located on the outside of the earpiece 318 to detect background audio 321, whilst the loudspeaker 320 is located on the opposite side of the earpiece 318 and is inserted in/towards the ear canal. The microphone 319 converts the background sound 321 to an electrical audio signal which is passed to an ANC processor 322. The job of the ANC processor 322 is to cancel out the background ambient sound as heard by the listener 323 through the headset by producing an inverted audio signal corresponding to this background sound (i.e. producing an altered background noise signal). The background sound 321 as heard through the headset (i.e. ambient sound which has leaked through the earpiece 318 to the ear canal) is very different from the sound detected by the earpiece microphone 319. For a start, the earpiece 318 blocks out much of the ambient noise 321. In addition, it introduces a number of audio artefacts which modify the ambient noise 321 (discussed below). In order to produce an effective noise cancellation signal, therefore, the ANC processor 322 has to estimate the noise field at the ear canal based on the background signal recorded by the earpiece microphone 319. It achieves this by reproducing the effects of the earpiece 318 and adding them to the recorded background signal before inverting the phase. The ANC processor 322 then sends the noise cancellation signal along with a primary audio signal (from a primary audio source 324) to the loudspeaker 320 for audio reproduction. In this way, the noise cancellation signal (altered background noise signal) cancels out the ambient sound 321, allowing reproduction of the primary audio without the background ambient noise 321.

Instead of sending the primary audio signal and noise cancellation signal to the loudspeaker for reproduction, the ANC processor 322 may pass the signals to a transmitter 325 for transmission to a remote device. In this scenario, because the earpiece 318 is not being used for audio reproduction (and therefore does not block the sound or introduce any audio artefacts), there is no need to estimate the background signal at the ear canal and reproduce the audio artefacts. Instead, the ANC processor 322 produces a noise cancellation signal corresponding to the background sound as detected by the earpiece microphones 319 (i.e. without any additional modification), and passes the noise cancellation signal with the primary audio signal to the transmitter 325.

Figure 4:
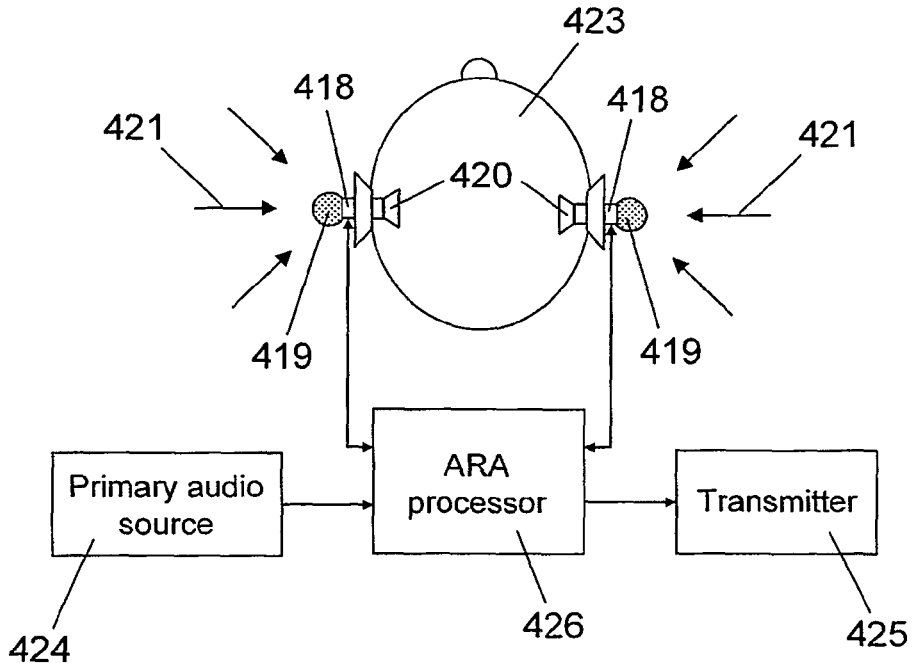
FIG. 4 illustrates schematically an augmented reality audio apparatus.

FIG. 4 illustrates schematically an augmented reality audio (ARA) apparatus. As mentioned in the background section, an ARA headset allows the playback of both primary and background audio signals at the same time. To achieve this, the (or each) earpiece 418 is equipped with a microphone 419 for capturing ambient sound 421 and converting it into an electrical audio signal (similarly to an ANC headset). This signal is then passed to an ARA processor 426. Ideally, the ARA headset should be acoustically transparent such that the reproduced background sound is identical to the background sound 421 as heard without the headset. However, because the headset introduces a number of audio artefacts which modify the ambient sound, equalization is required in order to produce a pseudo-acoustic representation of the surrounding environment. Equalization is performed by the ARA processor 426. The equalized background audio signal is then sent to an earpiece loudspeaker 420 together with the primary audio signal (from a primary audio source 424) for reproduction. In this way, the user hears the primary audio signal superimposed on the pseudo-acoustic representation.

As with the ANC processor, the ARA processor 426 may also pass the signals to a transmitter 425 for transmission to a remote device. In this scenario, because the earpiece 418 is not being used for audio reproduction (and therefore does not block the sound or introduce any audio artefacts), there is no need to equalize the background signal. Instead, the background signal from the earpiece microphones is passed to the transmitter 425 (with the primary audio signal) without any additional modification.

The external ear modifies the sound field in a number of ways while transmitting incident sound waves along the ear canal to the ear drum. The ear canal can be considered as a rigid tube which resonates when a sound wave travels along its length. In normal listening (i.e. without a headset), the ear canal is open and acts as a quarter-wavelength resonator. For an open ear canal, the first resonance occurs at around 2-4 kHz depending on the length of the canal. When an earpiece blocks the ear canal, however, the acoustic properties of the ear canal change. A closed tube acts as a half-wavelength resonator and also cancels the quarter-wavelength resonance. The half-wavelength resonance typically occurs around 5-10 kHz depending on the length of the ear canal and the fitting of the earpiece.

In order to make an ARA headset acoustically transparent, equalization is required to recreate the quarter-wavelength resonance and dampen the half-wavelength resonance. This may be achieved using two parametric resonators. Likewise, in order for an ANC headset to effectively cancel ambient noise which has been leaked to the ear canal, the ANC processor approximates the noise field at the ear canal by adding the half-wavelength resonance and subtracting the quarter-wavelength resonance before inverting the phase of the signal.

Furthermore, depending on the type of earpiece used, a headset will typically allow some of the background sound to reach the ear canal as leakage around and through the earpiece. The leaked sound is then detected by the ear drum along with the audio signal from the loudspeaker causing coloration (especially at low frequencies). In an ARA system, this coloration deteriorates the pseudo-acoustic representation and also needs to be corrected by equalization. This may be achieved using a high-pass filter to compensate for the additional low frequency sound. In an ANC system, the ANC processor must introduce coloration to the recorded signal in order to generate an inverted reproduction of the leaked ambient sound. But however the background audio signal picked up by the headset microphones is specifically altered for ARA purposes, ARA enables the primary audio signal to be reproduced substantially with the background audio signal.

As mentioned earlier, there are some situations where an audio headset user may wish to hear both primary and background audio simultaneously, and other situations where that user may wish to completely or partially block out the background audio. The primary audio signal may be a stored audio file such as an mp3, or a voice recording received from a microphone located locally or remotely to the headset. For example, the ANC headset may be used with an mp3 player to cancel the background noise whilst the user is listening to music stored on the mp3 player. On the other hand, the ANC headset may be used with a mobile phone to cancel the background noise during a call. In this scenario, noise cancellation is used to cancel background noise at his end in order to hear the other person's voice more clearly through the loudspeaker (i.e. downlink audio). However, it could also be used by the headset user to prevent the background noise at his end from being transmitted to the other person, thereby isolating the user's voice (i.e. uplink audio). In this situation, binaural headset microphones may be used to distinguish between the user's own voice and the background sound. This is necessary if the system is to transmit the user's voice but cancel the background noise. Binaural headset microphones achieve this by recognizing that the same sound (i.e. the user's voice) has been detected simultaneously as a result of the symmetric acoustic paths from the user's mouth to the left and right microphones. With this information, the ANC processor is able to produce a noise cancellation signal corresponding only to the remaining sound (i.e. the background noise) detected by the earpiece microphones.

Voice activity detection (VAD) may also be used to distinguish between speech and background sound for noise cancellation purposes. VAD is a technique used in speech processing to detect the presence or absence of human speech, and has applications in speech activity detection for automatic speech recognition (ASR), speech absence detection for noise estimation, speech coding and echo cancellation. Furthermore, additional sensing methods may also be applied to make the VAD more robust. The use of bone conduction by sensing body vibrations has been shown to facilitate differentiation of a user's own voice from sounds generated by a loudspeaker. Bone conduction headsets create vibrations in the human skull which travel to the inner ear and are detected by the cochlea. In contrast to headphones (earphones), bone conduction headsets do not block the ear canal, but suitably attach to the skin.

Although ANC technology could potentially be combined with ARA technology to provide some level of audio control, currently available ANC headsets are designed to cancel out all environmental sounds to improve the listening experience and are therefore unable to satisfy all of these requirements. There will now be described an apparatus and associated methods for providing greater user control over the uplink and downlink audio signals.

Figure 5:
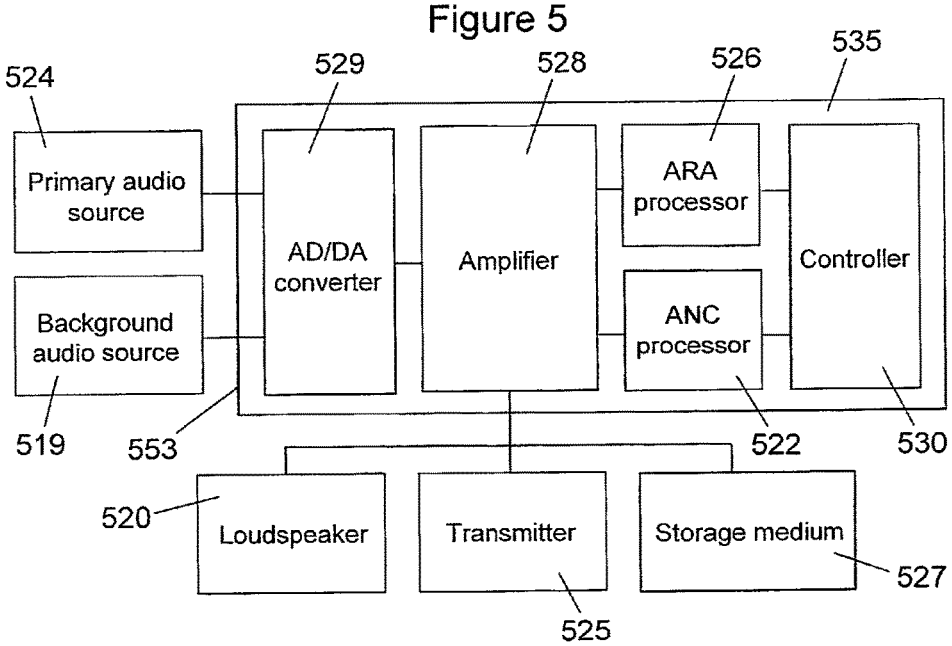
FIG. 5 illustrates schematically an apparatus for processing the audio signals.

FIG. 5 illustrates schematically an apparatus for controlling the perceived amplitude of the background audio signal. The apparatus comprises both ANC and ARA hardware and/or software features. Given that ANC and ARA require common components (i.e. earpiece microphones, audio processing and earpiece loudspeakers), ANC and ARA can be implemented within the same device/apparatus without the need for substantial hardware and/or software modifications.

The apparatus includes an ARA processor 526, an ANC processor 522 (although in other embodiments, the ARA 526 and ANC 522 processors could be combined as a single processor), primary 524 and background 519 audio sources, and a loudspeaker 520, as described with respect to FIGS. 3 and 4. The primary audio source 524 may be a local or remote storage medium, or a local or remote microphone. In the case of a remote storage medium or remote microphone, the apparatus would also require a receiver for receiving a primary audio signal from the primary audio source 524. The background audio source 519 may be a headset microphone as used in existing ARA and ANC headsets. For binaural audio production, two headset microphones would be required (one for each ear), each producing a separate background audio signal. The loudspeaker 520 may also form part of the headset. Again, for binaural audio production, separate headset loudspeakers are required for each ear.

The headset may comprise different types of earpiece. There are a wide variety of earpieces currently available which would be suitable for use. Circurnaural earpieces have circular or ellipsoid earpads that encompass the pinna. Because these earpieces completely surround the ear, these headsets can be designed to fully seal against the head to attenuate any intrusive background noise. Supra-aural earpieces have pads that sit against the pinna rather than around it, often made from a soft resilient material such as synthetic sponge which adapts to the shape of the pinna for noise attenuation and comfort. Earbuds are earpieces of a much smaller size and are placed directly outside the ear canal, but without enveloping it. Due to their inability to provide any isolation, they are often used at higher volumes in order to drown out background noise. Canalphones are earpieces which are inserted directly into the ear canal. Canalphones offer portability similar to earbuds, but provide greater isolation from background noise. Canalphones are usually made from silicone rubber, elastomer, or foam, and can be custom made to fit the user's ear canals. In the present apparatus, the headset earpiece should provide passive attenuation of sound from the surrounding environment. With this in mind, circumaural, supra-aural or canalphones (universal or custom made) are suitable.

The apparatus also incorporates an amplifier 528 between the signal sources 519, 524 and the processors 522, 526 to decrease the amplitude of the primary and background audio input signals so that they are suitable for processing. Additionally, the amplifier 528 is connected between the processors 522, 526 and the loudspeaker 520 for increasing the amplitude of the processed signal so that it is suitable for audio reproduction. The apparatus may also include a transmitter 525 and a storage medium 527 for transmitting the processed signal and recording the processed signal, respectively.

As previously described, the ARA processor 526 is configured to receive primary and background audio signals from the primary 524 and background 519 audio sources, equalize the background audio signal to remove audio artefacts introduced by the earpiece (downlink audio only), and combine the primary and background audio signals. The ANC processor 522, on the other hand, is configured to receive the background audio signal, recreate audio artefacts introduced by the earpiece (downlink audio only), and produce an inverted audio signal for phase cancellation. The ARA processor 526 is also configured to send the combined audio signal to the loudspeaker 520, transmitter 525 and/or storage medium 527 for audio reproduction, transmission to a remote device and/or audio recording, respectively. Likewise, the ANC processor 522 is configured to combine the noise cancellation signal with the background audio signal to alter the amplitude of the background audio signal.

To minimize latency, the apparatus may comprise analogue electronics (e.g. analogue circuitry, components and/or signals) rather than digital electronics. Digital signal processing causes delays of up to several milliseconds, which can be considered to be unacceptable with the present system because of audio leakage through the headset earpiece. If the ARA processor 526 used digital electronics, the leaked ambient sound would be heard before the equalized background audio signal, resulting in a comb filtering effect which colors the sound by attenuating some frequencies and amplifying others. If the ANC processor 522 used digital electronics, it may not be able to generate the noise cancellation signal in time to prevent the user from hearing the ambient sound. Where analogue electronics are used, the apparatus may comprise a digital-to-analogue (AD/DA) converter to convert digital audio signals into an analogue form suitable for processing. Alternatively, the apparatus may accept analogue audio signals. In this regard, one or more of the primary audio signal, background audio signal, noise cancellation signal, and combined audio signal may be analogue electronic signals. Given that an AD/DA converter may also introduce a time delay whilst converting the digital signals, however, the use of analogue signals might be more advantageous.

Although the ARA 526 and ANC 522 processors perform different tasks, they may be combined (as mentioned above) to provide greater control of the audio production. The apparatus comprises a controller 530 for controlling the ARA 526 and ANC 522 processors independently. The controller 530 may comprise a user interface to facilitate user control of the ARA 526 and ANC 522 processors. One possible user interface is illustrated schematically in FIG. 6. The user interface 631 is split into two sections, a first section 632 for controlling the downlink audio (i.e. the reproduced audio signal), and a second section 633 for controlling the uplink audio (i.e. the transmitted/recorded audio signal).

Figure 6:
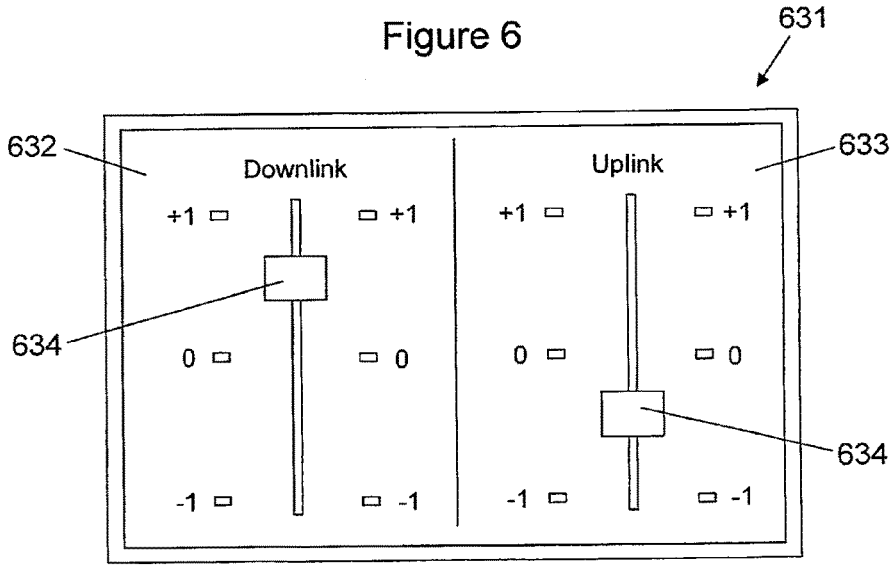
FIG. 6 illustrates schematically a user interface for controlling the amplitude of the background audio signal.

Each section 632, 633 comprises a slider 634 for varying the audio signal. Each slider can be independently moved between three main settings (+1, 0, and −1). The "+1" setting makes the headset acoustically transparent by turning the ARA functionality on and the ANC functionality off, the "0" setting turns both the ARA and the ANC functionality off, whilst the "−1" setting isolates the user from the acoustic environment by turning the ARA functionality off and the ANC functionality on. Advantageously, the sliders 634 may allow discrete or continuous selection. In FIG. 6, each slider 634 can be positioned arbitrarily between the three main settings (i.e. continuous selection).

When the sliders 634 are moved to the "+1" setting, the apparatus behaves as an ARA system. In this mode, the loudspeaker 520, transmitter 525 and storage medium 527 respectively reproduce, send and record a pseudo-acoustic representation of the surrounding environment superimposed by the primary audio signal. When the sliders 634 are moved to the "0" setting, the apparatus behaves as a regular audio system. In this mode, the loudspeaker 520, transmitter 525 and storage medium 527 respectively reproduce, send and record the primary audio signal, but some of the ambient noise is also heard, sent and recorded. When the sliders 634 are moved to the "−1" setting, the apparatus behaves as an ANC system. In this mode, the loudspeaker 520, transmitter 525 and storage medium 527 respectively reproduce, send and record the primary audio signal without any of the ambient noise.

When the sliders 634 are positioned between the "+1" and "0" settings, the apparatus behaves like a regular audio system but allows some background sound to be reproduced, sent or recorded. Likewise, when the sliders 634 are positioned between the "0" and "−1" settings, the apparatus behaves like a regular audio system but with partial noise cancellation. Effectively, therefore, the closer the sliders 634 are to the "+1" setting, the more background sound is reproduced, sent or recorded. Conversely, the closer the sliders are to the "−1" setting, the greater the noise cancellation.

The ARA and ANC processors may be controlled manually or automatically. With respect to automatic control, the system may be configured to use context information based on the user's actions, location, active applications (e.g. mp3 player, telephone call etc), or characteristics of the acoustic environment. For example, the system may detect that the user is in a telephone call, and completely cancel all background noise automatically (uplink and/or downlink audio) to improve audio clarity. On the other hand, the earpiece microphones may detect the sound of vehicle engines from the surrounding environment whilst the user is listening to music, and send the complete background signal to the earpiece loudspeakers (downlink audio) for safety reasons. In practice, examples of various environmental sounds could be stored for comparison with the present background sound. In this way, a reasonable match between the stored and present sounds may be used to determine the audio response. The system may also be configured to monitor and store previous manual settings to "learn" user preferences (and the associated hardware/software may be referred to as a "context learning engine"). In addition, the system may be configured to allow a user's manual settings to overwrite the system's automatic settings. This feature allows the user to control the uplink and downlink audio regardless of any automatic setting, which is important if the user's preferences change over time.

Noise cancellation itself may be performed in different ways using the sliders. For example, if the frequency and amplitude of the noise cancellation signal are identical to the respective frequency and amplitude of the background audio signal, the slider could be used to vary the phase relationship between the noise cancellation signal and the background audio signal to alter the amplitude of the background audio signal.

On the other hand, if the frequency of the noise cancellation signal is identical to the frequency of the background audio signal, and the noise cancellation audio signal is 180 degrees out of phase with the background audio signal, the sliders could be used to vary the amplitude of the noise cancellation signal to alter the amplitude of the background audio signal.

As shown in FIG. 5, the ARA 526 and ANC 522 processors, the amplifier 528, the controller 530 and the AD/DA converter 529 are grouped together as a single processing unit 535. Furthermore, the ARA 526 and ANC 522 processors may or may not be combined as a single processor (or processing/circuitry module). The primary audio source 524 (microphone or receiver), background audio source 519 (headset microphones), loudspeaker 520 (headset loudspeakers), transmitter 525 and storage medium 527 may be electrically connected to the processing unit 535 via any suitable connectors 553.

Some potential applications of the present apparatus and methods will now be described. One such application is the audio tourist guide. For this application, the apparatus also requires location and orientation detectors for determining the user's geographical location and the orientation of the user's head, respectively. The location detector may comprise GPS (Global Positioning System) technology, whilst the orientation detector may comprise an accelerometer, a gyroscope, a compass or any other head-tracking technology. As the user moves around, primary audio signals, which may be received from a local or remote audio source, are sent to the loudspeaker for reproduction. The audio signals comprise information about the specific sights the user visits, and correspond to the current location and orientation data. For example, if the location and orientation detectors determined that the user was facing a cathedral, a primary audio signal comprising information about the cathedral could be sent to the loudspeaker for audio reproduction (and may or may not be superimposed on the background audio). The location detector may also be used to guide the user to a specific sight. This application could potentially serve as a substitute for a human tourist guide, and would allow the user additional freedom to explore an area by himself/herself without predetermined routes or schedules. A further advantage of the present apparatus is that the user has control over the amplitude of the background audio signal. For example, the user may increase the amplitude of the background audio signal when travelling between sights, and then decrease the amplitude of the background audio signal once he/she has arrived at a sight of interest.

Figure 7A:
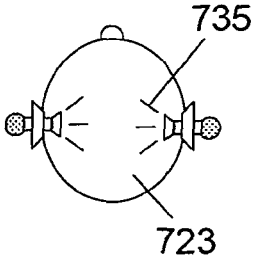
FIG. 7 *a* illustrates schematically the detection of a primary audio signal without audio cues for sound localization.
Figure 7B:
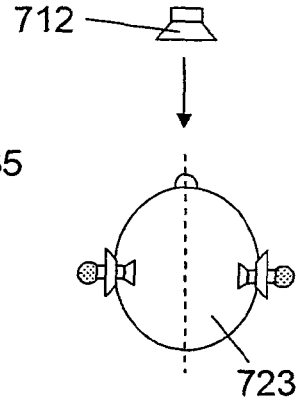
Figure 7C:
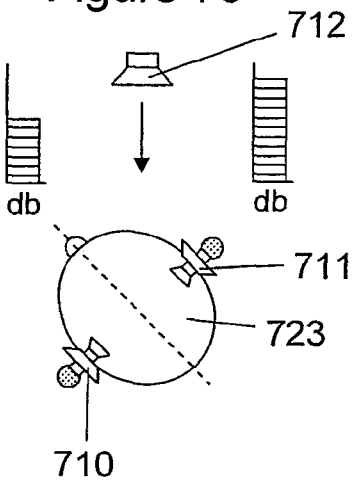

Furthermore, the apparatus may modify the primary audio signal based on the location and orientation data to enable localization of the sound. In practice, this may be achieved by determining the azimuth (horizontal angle), elevation (vertical angle), and distance between the user and the sight of interest using the location and orientation detectors, and based on this information, calculating and introducing interaural time difference (ITD) and interaural level difference (ILD) into the primary audio signal. This feature is illustrated in FIG. 7. In this way, rather than omnidirectional sound 735 (FIG. 7 *a*), the information can be made to sound as though it originates from the sight of interest 712 itself (FIG. 7 *b*). For example, if the location and orientation data indicate that the user 723 is standing with his/her right ear 711 oriented towards a sight of interest 712 and his/her left ear 710 oriented away from the sight of interest 712, the primary audio signal may be modified in such a way that the amplitude of the audio signal is greater in the right ear 711 than it is in the left ear 710 (FIG. 7 *c*).

Figure 8:
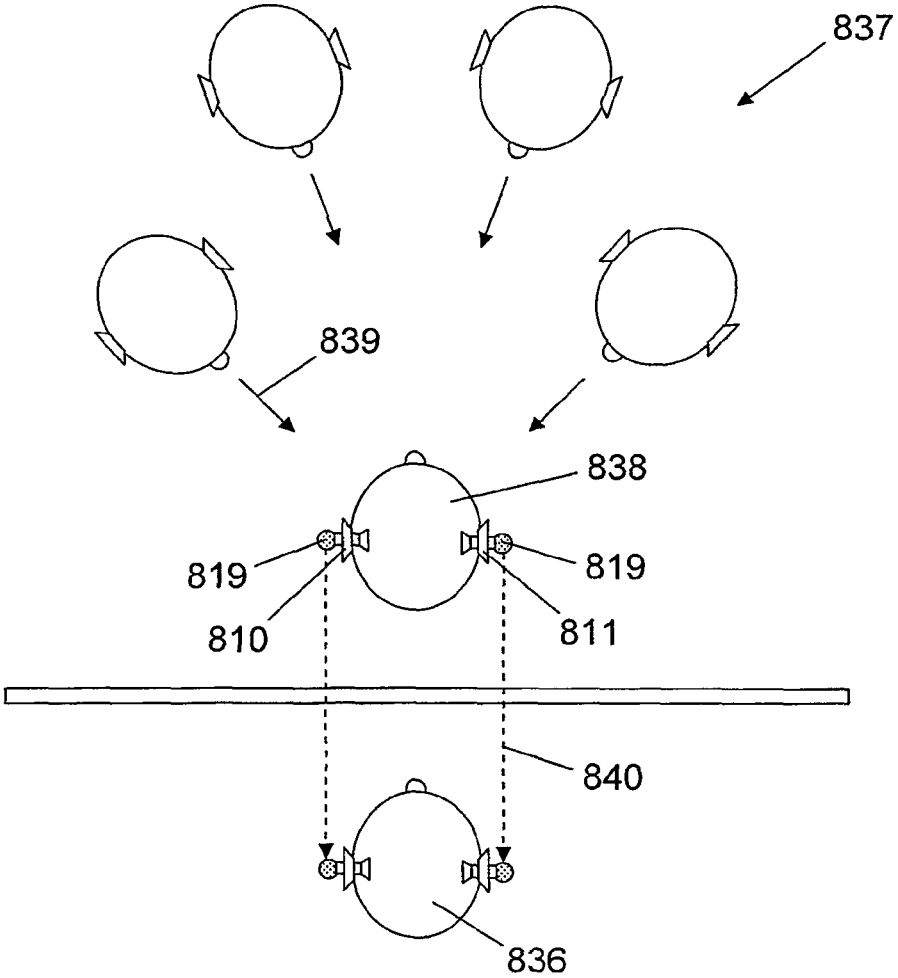
FIG. 8 illustrates schematically an audio conference using an embodiment of the apparatus described herein.

Another application is the audio conference, as illustrated in FIG. 8. Typically, audio conferences are held using telephones with speakerphone functionality. During an audio conference, a remote participant 836 speaks into his/her microphone and his/her voice is reproduced for a group of local participants 837 via a speakerphone at the other end of the phone line. Likewise, when participants 837 from the local group speak, their voices are detected by a microphone and reproduced at the remote end. One problem with this setup, however, is the lack of telepresence. This is because the sound is reproduced through a single loudspeaker with no directionality.

This can be improved dramatically using the present apparatus and methods. If one group member 838 (or a dummy head replicating human features) wears, or suitably positions, the headset/apparatus, the voice 839 of each group member 837 will be detected using the headset microphones 819. Since the microphones 819 are located in the ears 810, 811 of the group member 838, the detected signal contains directional information based on binaural cues. When the signal is then transmitted 840 to the remote participant 836, also wearing the headset/apparatus (or with a suitably positioned headset/apparatus), this directional information is preserved during audio playback. This allows the remote participant 836 to feel as though he/she is present in the same room as the group of local participants 837 during the audio conference.

Figure 9:
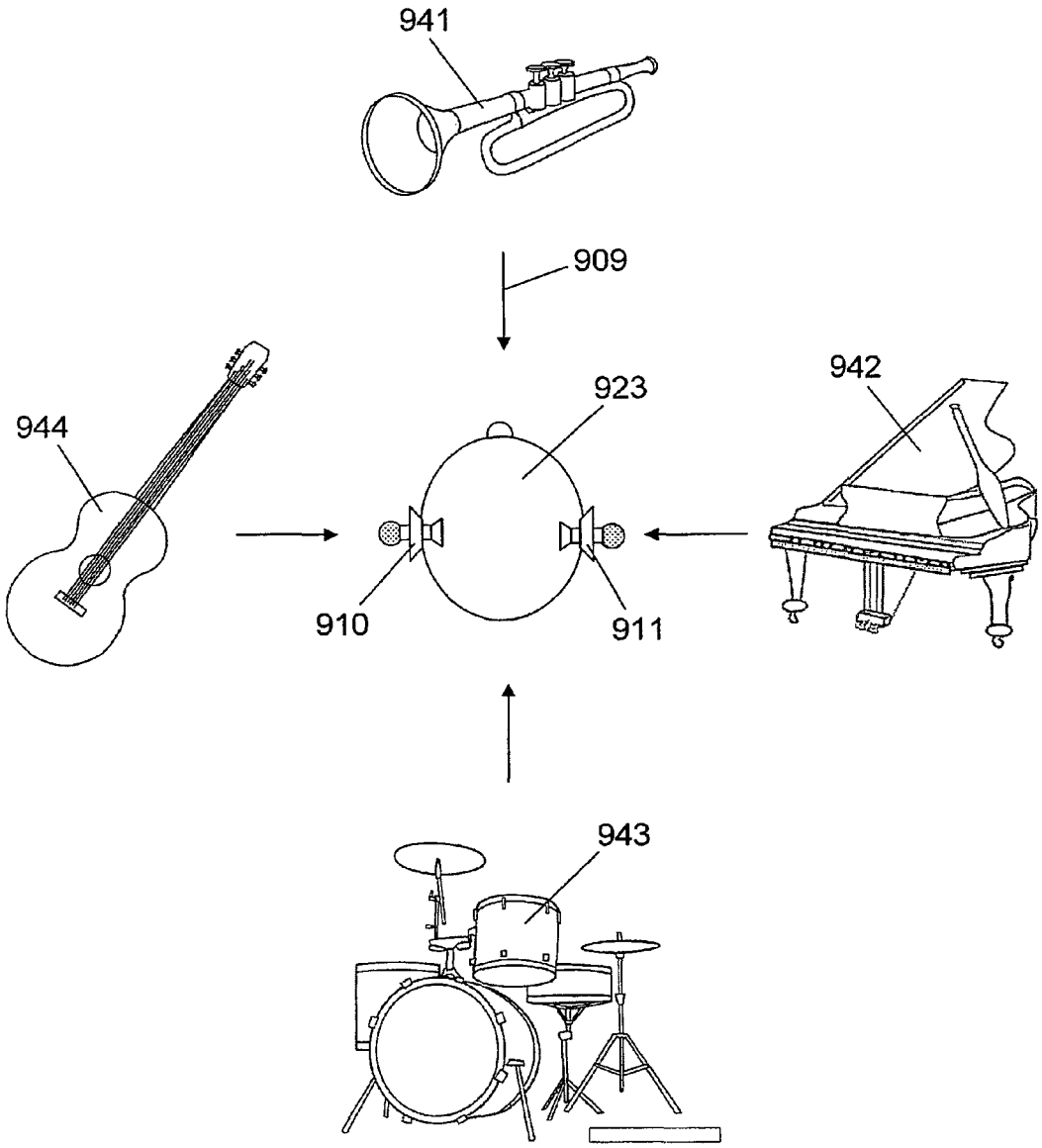
FIG. 9 illustrates schematically a binaural recording using an embodiment of the apparatus described herein.

The apparatus may also be used for binaural recording, as illustrated in FIG. 9. Most audio recordings are intended for playback using stereo or multi-channel speakers, and not for headphones. When these sounds are recorded, multiple microphones are spaced apart at different points within the recording studio to capture some level of directionality. Despite this, however, the reproduced sound does not allow the listener to fully localize the sound. This is because the HRTF has not been incorporated into the recording. If someone (or a dummy head replicating human features) wears the headset in the recording studio whilst the sound is being recorded, however, the HRTF can be incorporated into the recorded signal. When the recorded signal is subsequently reproduced using headphones, the listener is able to localize each sound using the HRTF and other binaural cues.

For example, if a person 923 sits in the center of a concert hall during a musical performance wearing the headset, the sound waves 909 from each musical instrument (e.g. trumpet 941, piano 942, drums 943 and guitar 944) will be incident upon the user's ears 910, 911 at different angles, and at different amplitudes, based on the positioning of the instruments 941-944. Binaural recording using the apparatus would allow this directional information to be preserved. In this way, subsequent reproduction of the recorded sound using a pair of headphones would create the impression of being physically present at the center of the concert hall during the performance.

Figure 10:
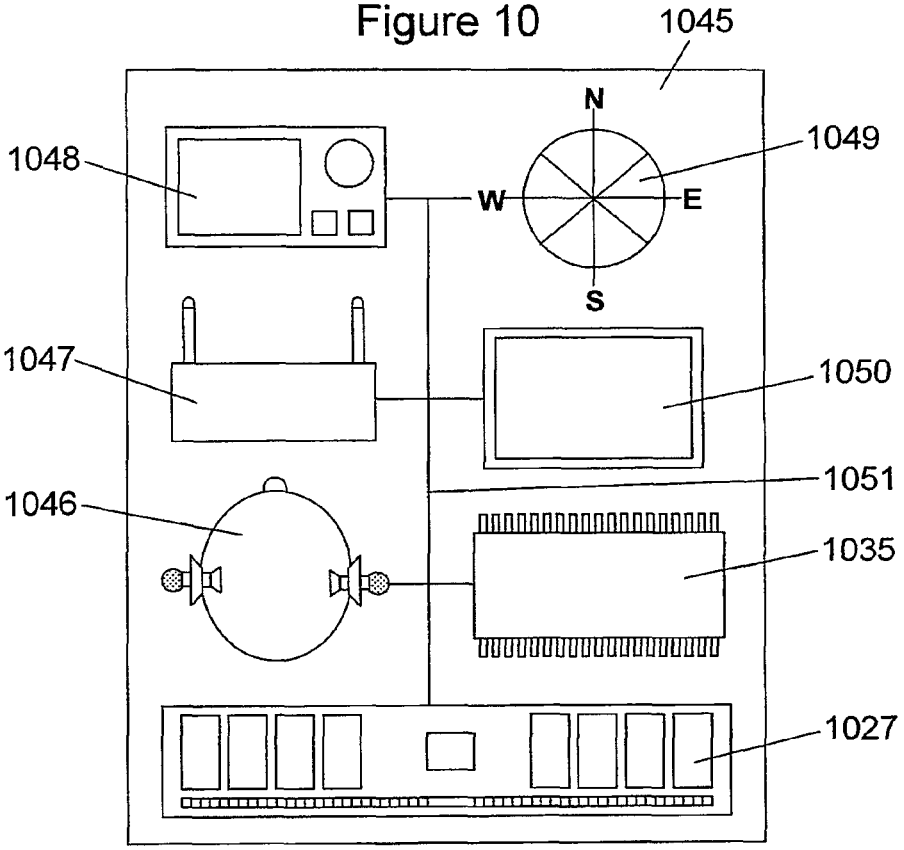
FIG. 10 illustrates schematically an electronic device comprising an embodiment of the apparatus described herein.

FIG. 10 illustrates schematically an electronic device 1045 comprising the apparatus described herein, including both the headset 1046 and the processing unit 1035. The device also comprises a transceiver 1047, a location detector 1048, an orientation detector 1049, an electronic display 1050, and a storage medium 1027, which may be electrically connected to one another by a databus 1051. The device 1045 may be a portable electronic device, such as a portable telecommunications device.

The headset 1046 is configured to detect background sound and reproduce a user-controlled combined audio signal comprising a primary audio signal and an equalized background audio signal. As previously discussed, the equalized background audio signal may or may not be fully or partially cancelled by a noise cancellation signal. The headset 1046 may comprise circumaural, supra-aural, ear-bud or canalphone earpieces. In addition, the headset may comprise one or two earpiece microphones and one or two corresponding earpiece loudspeakers for monaural or binaural audio capture and playback, respectively.

The processing unit 1035 is configured for general operation of the device 1045 by providing signalling to, and receiving signalling from, the other device components to manage their operation. In particular, the processing unit 1035 is configured to allow user control of the audio output via the controller.

The transceiver 1047 (which may comprise separate transmitter and receiver parts) is configured to receive primary audio signals from remote devices, and transmit the audio output signal to remote devices. The transceiver 1047 may be configured to transmit/receive the audio signals over a wired or wireless connection. The wired connection may comprise a data cable, whilst the wireless connection may comprise Bluetooth™, infrared, a wireless local area network, a mobile telephone network, a satellite internet service, a worldwide interoperability for microwave access network, or any other type of wireless technology.

The location detector 1048 is configured to track the geographical location of the device 1045 (which is worn or carried by the user), and may comprise GPS technology. The orientation detector 1049 is configured to track the orientation or the user's head and/or body in three dimensions, and may comprise an accelerometer, a gyroscope, a compass, or any other head-tracking technology.

The electronic display 1050 is configured to display a user interface for controlling the ARA and ANC processors. The user interface may look and function as described with reference to FIG. 6. The electronic display 1050 may also be configured to display the current geographical location of the device, for example, as a digital map. Furthermore, the electronic display 1050 may be configured to provide a list of stored audio files selectable for audio playback or transmission, and may also be configured to provide a list of in-range remote devices with which a wired/wireless connection can be established for transmitting/receiving audio signals. The electronic display 1050 may be an organic LED, inorganic LED, electrochromic, electrophoretic, or electrowetting display, and may comprise touch sensitive technology (which may be resistive, surface acoustic wave, capacitive, force panel, optical imaging, dispersive signal, acoustic pulse recognition, or bidirectional screen technology).

The storage medium 1027 is configured to store computer code required to operate the apparatus, as described with reference to FIG. 12. The storage medium 1027 may also be configured to store audio files (i.e. the primary audio signals). The storage medium 1027 may be a temporary storage medium such as a volatile random access memory, or a permanent storage medium such as a hard disk drive, a flash memory, or a non-volatile random access memory.

Figure 11:
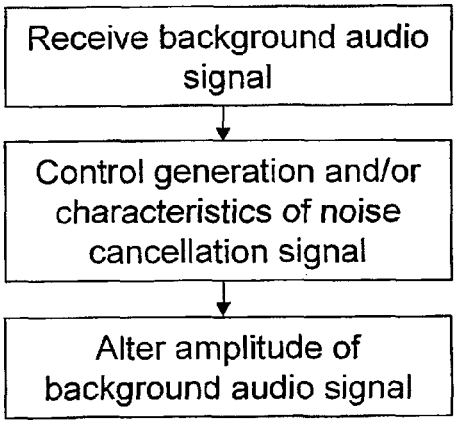
FIG. 11 illustrates schematically a method of controlling the production of an audio signal.

The method used to control the audio output using the apparatus described herein are summarized schematically in FIG. 11.

Figure 12:
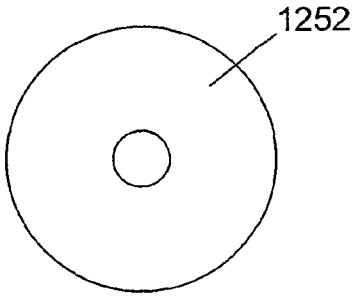
FIG. 12 illustrates schematically a computer readable media providing a computer program.

FIG. 12 illustrates schematically a computer/processor readable medium 1252 providing a computer program according to one embodiment. In this example, the computer/processor readable medium 1252 is a disc such as a digital versatile disc (DVD) or a compact disc (CD). In other embodiments, the computer/processor readable medium 1252 may be any medium that has been programmed in such a way as to carry out an inventive function. The computer/processor readable medium 1252 may be a removable memory device such as a memory stick or memory card (SD, mini SD or micro SD).

The computer program may comprise code for controlling the audio output using the apparatus described herein by receiving a background audio signal from an earpiece microphone, the earpiece microphone configured to convert sound from a surrounding environment into the background audio signal; and allowing user control of the generation and/or characteristics of a noise cancellation signal, the noise cancellation signal configured to interfere destructively with the background audio signal to alter the amplitude of the background audio signal.

Other embodiments depicted in the figures have been provided with reference numerals that correspond to similar features of earlier described embodiments. For example, feature number 1 can also correspond to numbers 101, 201, 301 etc. These numbered features may appear in the figures but may not have been directly referred to within the description of these particular embodiments. These have still been provided in the figures to aid understanding of the further embodiments, particularly in relation to the features of similar earlier described embodiments.

It will be appreciated to the skilled reader that any mentioned apparatus, device, server or sensor and/or other features of particular mentioned apparatus, device, or sensor may be provided by apparatus arranged such that they become configured to carry out the desired operations only when enabled, e.g. switched on, or the like. In such cases, they may not necessarily have the appropriate software loaded into the active memory in the non-enabled (e.g. switched off state) and only load the appropriate software in the enabled (e.g. on state). The apparatus may comprise hardware circuitry and/or firmware. The apparatus may comprise software loaded onto memory. Such software/computer programs may be recorded on the same memory/processor/functional units and/or on one or more memories/processors/functional units.

In some embodiments, a particular mentioned apparatus, device, or sensor may be pre-programmed with the appropriate software to carry out desired operations, and wherein the appropriate software can be enabled for use by a user downloading a "key", for example, to unlock/enable the software and its associated functionality. Advantages associated with such embodiments can include a reduced requirement to download data when further functionality is required for a device, and this can be useful in examples where a device is perceived to have sufficient capacity to store such pre-programmed software for functionality that may not be enabled by a user.

It will be appreciated that the any mentioned apparatus, circuitry, elements, processor or sensor may have other functions in addition to the mentioned functions, and that these functions may be performed by the same apparatus, circuitry, elements, processor or sensor. One or more disclosed aspects may encompass the electronic distribution of associated computer programs and computer programs (which may be source/transport encoded) recorded on an appropriate carrier (e.g. memory, signal).

It will be appreciated that any "computer" described herein can comprise a collection of one or more individual processors/processing elements that may or may not be located on the same circuit board, or the same region/position of a circuit board or even the same device. In some embodiments one or more of any mentioned processors may be distributed over a plurality of devices. The same or different processor/processing elements may perform one or more functions described herein.

It will be appreciated that the terms "signal" or "signalling" may refer to one or more signals transmitted as a series of transmitted and/or received signals. The series of signals may comprise one, two, three, four or even more individual signal components or distinct signals to make up said signalling. Some or all of these individual signals may be transmitted/received simultaneously, in sequence, and/or such that they temporally overlap one another.

With reference to any discussion of any mentioned computer and/or processor and memory (e.g. including ROM, CD-ROM etc), these may comprise a computer processor, Application Specific Integrated Circuit (ASIC), field-programmable gate array (FPGA), and/or other hardware components that have been programmed in such a way to carry out the inventive function.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

While there have been shown and described and pointed out fundamental novel features as applied to different embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

from inputs received at one or more processors, separating a background audio signal representing background sound from a primary audio signal; and outputting the primary audio signal with a version the background audio signal that is altered according to a user selection between noise cancellation and ambient sound reproduction, wherein:

when the user selection is for noise cancelation, the primary audio signal and the background audio signal are output with a first altered version of the background audio; and when the user selection is for ambient sound reproduction, the primary audio signal is output with a second altered version of the background audio signal that mitigates audio artefacts introduced by a headset that alter the background sound from the perspective of a user's ear canal that is separated from the background sound by the headset.

2. The method according to claim 1, wherein the primary audio signal with the altered version of the background signal is output to one or more headset speakers of the headset in which the one or more processors is disposed; and the second altered version of the background audio signal is a pseudo-acoustic representation of the background sound which is equalized to mimic the background sound which is outside the headset.

3. The method according to claim 2, further comprising creating the second altered version of the background audio signal by equalizing the background audio signal to re-create quarter-wave-length resonance and to dampen half-wave-length resonance.

4. The method according to claim 2, further comprising creating the first altered version of the background audio signal by adding half-wave-length resonance to the background audio signal and further by subtracting quarter-wave-length resonance from the background audio signal prior to inverting phase of the background audio signal.

5. The method according to claim 1, wherein the primary audio signal with the altered version of the background audio signal is output to a radio transmitter along with binaural information corresponding to directionality of a source of at least the primary audio signal.

6. The method according to claim 1, wherein the primary audio signal comprises one of:

an audio file stored on a memory; and a mobile phone voice call.

7. The method according to claim 1, wherein the primary audio signal with the version of the background audio signal is output to one or more headset speakers of the headset in which the one or more processors is disposed, wherein:

the inputs comprise the primary audio signal and the background audio signal which are received together from one or more headset microphones of the headset; and at least a voice activity detector is used to separate the primary audio signal from the background audio signal.

8. An apparatus comprising:

at least one processor; and at least one memory including computer program code, the at least one memory and the computer program code are configured, with the at least one processor, to cause the apparatus to perform at least the following:

from inputs received at the at least one processor, separate a background audio signal representing background sound from a primary audio signal; and output the primary audio signal with a version of the background audio signal that is altered according to a user selection between noise cancellation and ambient sound reproduction, wherein:

when the user selection is for noise cancelation, the primary audio signal and the background audio signal are output with a first altered version of the background audio signal; and when the user selection is for ambient sound reproduction, the primary audio signal is output with a second altered version of the background audio signal that mitigates audio artefacts introduced by a headset that alter the background sound from the perspective of a user's ear canal that is separated from the background sound by the headset.

9. The apparatus according to claim 8, wherein the apparatus comprises a headset further comprising one or more headset speakers and the primary audio signal with the altered version of the background audio signal is output to the one or more headset speakers; and the second altered version of the background audio signal is a pseudo-acoustic representation of the background sound which is equalized to mimic the background sound which is outside the headset.

10. The apparatus according to claim 9, wherein the at least one memory and the computer program code are configured, with the at least one processor, to cause the apparatus to create the second altered version of the background audio signal by equalizing the background audio signal to re-create quarter-wave-length resonance and to dampen half-wave-length resonance.

11. The apparatus according to claim 9, wherein the at least one memory and the computer program code are configured, with the at least one processor, to cause the apparatus to create the first altered version of the background audio signal by adding half-wave-length resonance to the background audio signal and further by subtracting quarter-wave-length resonance from the background audio signal prior to inverting phase of the background audio signal.

12. The apparatus according to claim 8, wherein the primary audio signal with the altered version of the background audio signal is output to the transmitter along with binaural information corresponding to directionality of a source of at least the primary audio signal.

13. The apparatus according to claim 8, wherein the primary audio signal comprises one of:

an audio file stored on a memory; and a mobile phone voice call.

14. The apparatus according to claim 8, wherein:

the apparatus comprises a headset further comprising one or more headset speakers, one or more headset microphones, and a voice activity detector; and the primary audio signal with the altered version of the background audio signal is output to the one or more headset speakers, and wherein the inputs comprise the primary audio signal received together with the background audio signal from the one or more headset microphones; and the voice activity detector is utilized to separate the primary audio signal from the background audio signal.

15. A non-transitory computer readable memory comprising computer readable instructions that when executed, implement a computer program for controlling production of an audio signal, the computer program comprising:

code for separating a background audio signal representing background sound from a primary audio signal; and code for outputting the primary audio signal with a version of the background audio signal that is altered according to a user selection between noise cancellation and ambient sound reproduction, wherein:

when the user selection is for noise cancelation, the primary audio signal and the background audio signal are output with a first altered version of the background audio signal; and when the user selection is for ambient sound reproduction, the primary audio signal is output with a second altered version of the background audio signal that mitigates audio artefacts introduced by a headset that alter the background sound from the perspective of a user's ear canal that is separated from the background sound by the headset.

16. The non transitory computer readable memory according to claim 15, wherein the primary audio signal with the altered version of the background audio signal is output to one or more headset speakers of a headset in which the one or more processors is disposed; and the second altered version of the background audio signal is a pseudo-acoustic representation of the background sound which is equalized to mimic the background sound which is outside the headset.

17. The non-transitory computer readable memory according to claim 15, wherein the primary audio signal with the altered version of the background audio signal is output to one or more headset speakers of a headset in which the memory is disposed, and wherein:

the primary audio signal and the background audio signal are received together from one or more headset microphones of the headset; and the computer program utilizes at least a voice activity detector to separate the primary audio signal from the background audio signal.

* * * * *